US012232636B2

(12) United States Patent
Merrick et al.

(10) Patent No.: US 12,232,636 B2
(45) Date of Patent: Feb. 25, 2025

(54) MODIFIABLE CABINET FOR CHECKOUT SYSTEM

(71) Applicant: TOSHIBA GLOBAL COMMERCE SOLUTIONS, INC., Durham, NC (US)

(72) Inventors: Dora Merrick, Flower Mound, TX (US); Brad M. Johnson, Raleigh, NC (US); Kimberly A. Wood, Raleigh, NC (US); Suzanne M. Bleakley, Cary, NC (US); William L. Dungan, Cary, NC (US)

(73) Assignee: TOSHIBA GLOBAL COMMERCE SOLUTIONS, INC., Durham, NC (US)

( * ) Notice: Subject to any disclaimer, the term of this patent is extended or adjusted under 35 U.S.C. 154(b) by 0 days.

(21) Appl. No.: 18/344,021

(22) Filed: Jun. 29, 2023

(65) Prior Publication Data

US 2025/0000283 A1 Jan. 2, 2025

(51) Int. Cl.
*A47F 9/04* (2006.01)

(52) U.S. Cl.
CPC ..... *A47F 9/048* (2013.01)

(58) Field of Classification Search
CPC ..... A47F 9/048
See application file for complete search history.

(56) References Cited

U.S. PATENT DOCUMENTS

| | | | | |
|---|---|---|---|---|
| 6,145,737 | A * | 11/2000 | Imai | G07F 19/20 232/15 |
| 8,033,454 | B2 * | 10/2011 | MacDonald | G07F 19/20 902/22 |
| 8,157,162 | B2 * | 4/2012 | Jonsson | G07D 11/34 235/383 |
| 10,726,681 | B1 * | 7/2020 | Durieux | G07G 1/0036 |
| 2002/0170782 | A1 | 11/2002 | Millikan | |
| 2008/0035813 | A1 | 2/2008 | O'Keene et al. | |
| 2011/0233352 | A1 | 9/2011 | Chou et al. | |
| 2014/0279119 | A1 * | 9/2014 | Knoll | G06Q 90/00 235/383 |
| 2023/0038835 | A1 * | 2/2023 | Johnson | A47B 88/944 |

* cited by examiner

*Primary Examiner* — Sonji N Johnson
(74) *Attorney, Agent, or Firm* — Patterson + Sheridan, LLP

(57) ABSTRACT

The present disclosure describes a system (e.g., a self-checkout system) that includes a modifiable cabinet. The self-checkout system includes a cabinet, a scanner, a sleeve, and a panel. The cabinet includes a front side and a back side opposite the front side. The scanner is positioned on the cabinet. The scanner scans an item during checkout. The sleeve is positioned within the cabinet. The sleeve moves away from the front side of the cabinet and out the back side of the cabinet. The sleeve defines a chamber. The panel is positioned within the chamber. When the sleeve is moved away from the front side of the cabinet and out the back side of the cabinet, the panel folds down to create a shelf within the chamber.

9 Claims, 14 Drawing Sheets

MODIFIABLE CABINET FOR CHECKOUT SYSTEM

BACKGROUND

The present disclosure relates to checkout systems, and more specifically, to a modifiable cabinet for checkout systems. Existing checkout systems include cabinets that house the equipment used to implement the checkout systems, such as computers, power supplies, money handlers (e.g., bill and coin dispensers), etc. The equipment, however, may fill the space in the cabinet, which may make it difficult to add more equipment into the cabinet. For example, some stores may want to add network switches, backup batteries, security tag deactivators, power strips, etc. to the cabinet. There may not be enough space in the cabinet to fit this additional equipment. In some instances, the stores may try to pack or stuff the additional equipment into the cabinet, which leads to poor air flow and overheating. Additionally, stuffing the cabinet makes it difficult to service and maintain the original equipment in the cabinet.

DETAILED DESCRIPTION

The present disclosure describes a checkout system (e.g., a self-checkout system) that includes a modifiable cabinet. Generally, the cabinet includes a sleeve that can be used to expand the storage capacity of the cabinet. For example, the sleeve may be pulled out from a back side of the cabinet. Additional equipment may then be stored in the chamber defined by the sleeve. Moreover, panels in the sleeve may fold down to create shelves when the sleeve is pulled out from the back side of the cabinet. The additional equipment may be positioned on the shelves for better organization.

Technical Advantages

The modifiable cabinet allows stores to expand the storage capacity of the checkout cabinets. For example, additional equipment may be added to the cabinet by storing the equipment in the chamber of the sleeve. Moreover, the equipment may be better organized in the cabinet, which improves airflow in the cabinet and reduces the chances of overheating.

Figure 1A:
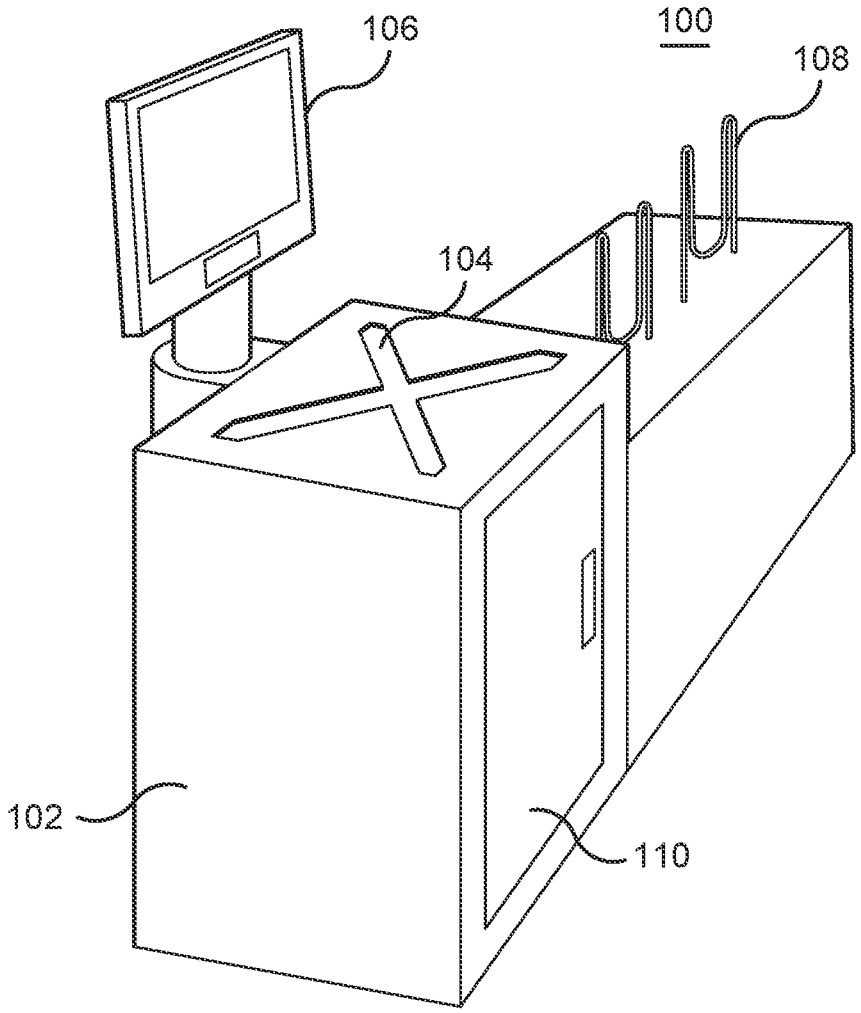
FIGS. 1A and 1B illustrate an example system.
Figure 1B:
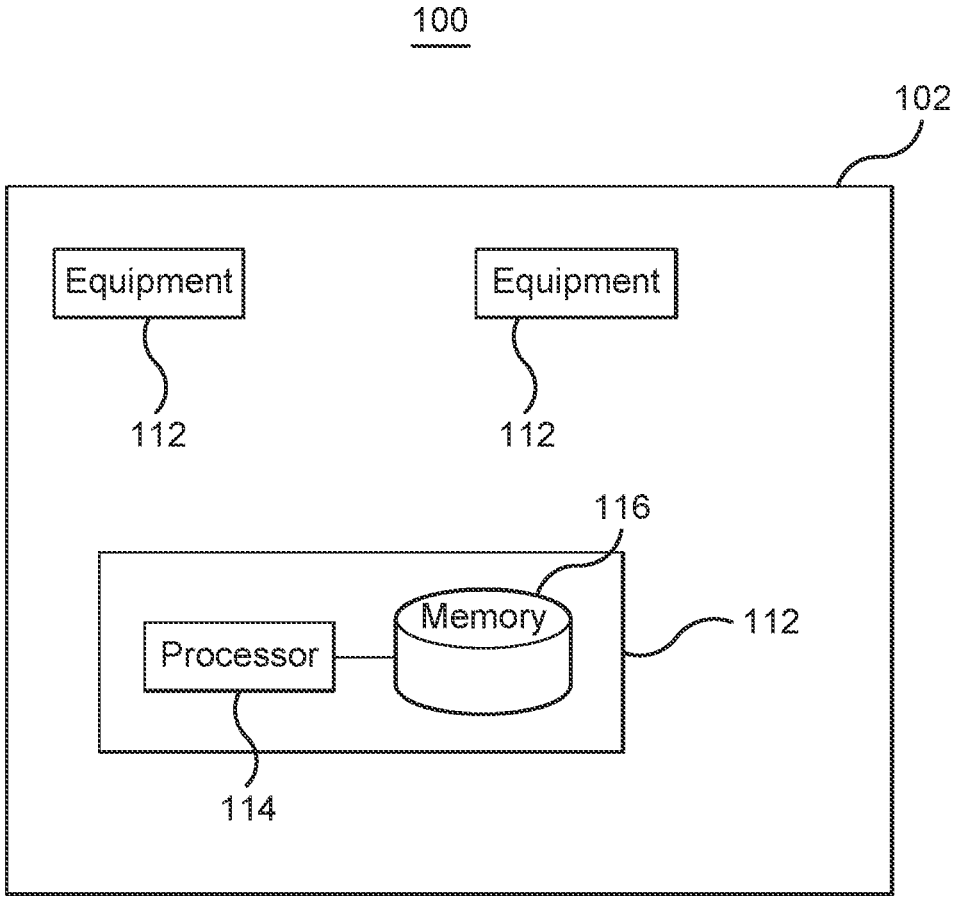

FIGS. 1A and 1B illustrate an example system 100. Generally, the system 100 may be a checkout system (e.g., a self-checkout system) in a store. Users may bring items to the system 100 and scan the items. The system 100 may track the prices of the scanned items. The users may also bag the items and then pay for the items. As seen in FIG. 1A, the system 100 includes a cabinet 102, a scanner 104, a display 106, and a bagging area 108.

The cabinet 102 may store or contain equipment used to implement the checkout features of the system 100. For example, the cabinet 102 may include computers, networking equipment, and power supplies that implement the checkout features of the system 100. As seen in FIG. 1A, the cabinet 102 may include a door 110 that may be opened to provide access to the interior or the cabinet 102. For example, by opening the door 110, it may be possible to access the equipment stored within the cabinet 102 to replace or service the equipment.

In particular embodiments, the interior of the cabinet 102 may be expanded by pulling out or attaching a sleeve to the cabinet 102. For example, the sleeve may be pulled out from or attached to the back side of the cabinet 102 to expand the storage capacity of the cabinet 102. The sleeve may provide or include shelves onto which additional equipment may be positioned or stored. By using the sleeve, the storage capacity of the cabinet 102 may be expanded to accommodate additional equipment for the system 100. When the extra storage capacity is not needed, the sleeve may be pushed into the cabinet 102 (for storage) or detached from the cabinet 102. As a result, the cabinet 102 is modifiable to increase the storage capacity of the cabinet 102 as needed.

The scanner 104 may scan items that a user intends to purchase. As seen in FIG. 1A, the scanner 104 may be positioned on top of the cabinet 102. The scanner 104 may use any suitable scanning technology to scan codes on the items. For example, the scanner 104 may scan barcodes (e.g., linear barcodes or two-dimensional barcodes) on the items to identify the items being scanned.

The display 106 may be attached to the cabinet 102 and may be positioned by the scanner 104. The display 106 may present information to the user as the user scans items. For example, the display 106 may display information about the item being scanned along with the price of the item. The display 106 may also present a running total of the user's purchase.

The user may store scanned items in the bagging area 108. The bagging area 108 may include stanchions and bags that the user can use to hold or store the scanned items. The bagging area 108 may also include shelves or other containers that the user can use to store scanned items. After the user has finished scanning items, the user may pay for the scanned items. The user may then take or remove the scanned items from the bagging area 108.

FIG. 1B illustrates some of the equipment in the system 100. As seen in FIG. 1B, the cabinet 102 may store or contain equipment 112. The equipment 112 may include network equipment, power supplies, and computers. As seen in FIG. 1B, the equipment 112 in the cabinet 102 may be a computer system that includes a processor 114 and a memory 116, which perform some of the checkout functions or actions of the system 100. For example, the processor 114 and the memory 116 may identify scanned items and determine the price of scanned items using outputs from the scanner 104. The processor 114 and the memory 116 may also present information on the display 106.

The processor 114 is any electronic circuitry, including, but not limited to one or a combination of microprocessors, microcontrollers, application specific integrated circuits (ASIC), application specific instruction set processor (ASIP), and/or state machines, that communicatively couples to memory 116 and controls the operation of the system 100. The processor 114 may be 8-bit, 16-bit, 32-bit, 64-bit or of any other suitable architecture. The processor 114 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The processor 114 may include other hardware that operates software to control and process information. The processor 114 executes software stored on the memory 116 to perform any of the functions described herein. The processor 114 controls the operation and administration of the system 100 by processing information (e.g., information received from the scanner 104 and memory 116). The processor 114 is not limited to a single processing device and may encompass multiple processing devices.

The memory 116 may store, either permanently or temporarily, data, operational software, or other information for the processor 114. The memory 116 may include any one or a combination of volatile or non-volatile local or remote devices suitable for storing information. For example, the memory 116 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory 116, a disk, a CD, or a flash drive. In particular embodiments, the software may include an application executable by the processor 114 to perform one or more of the functions described herein.

Figure 2A:
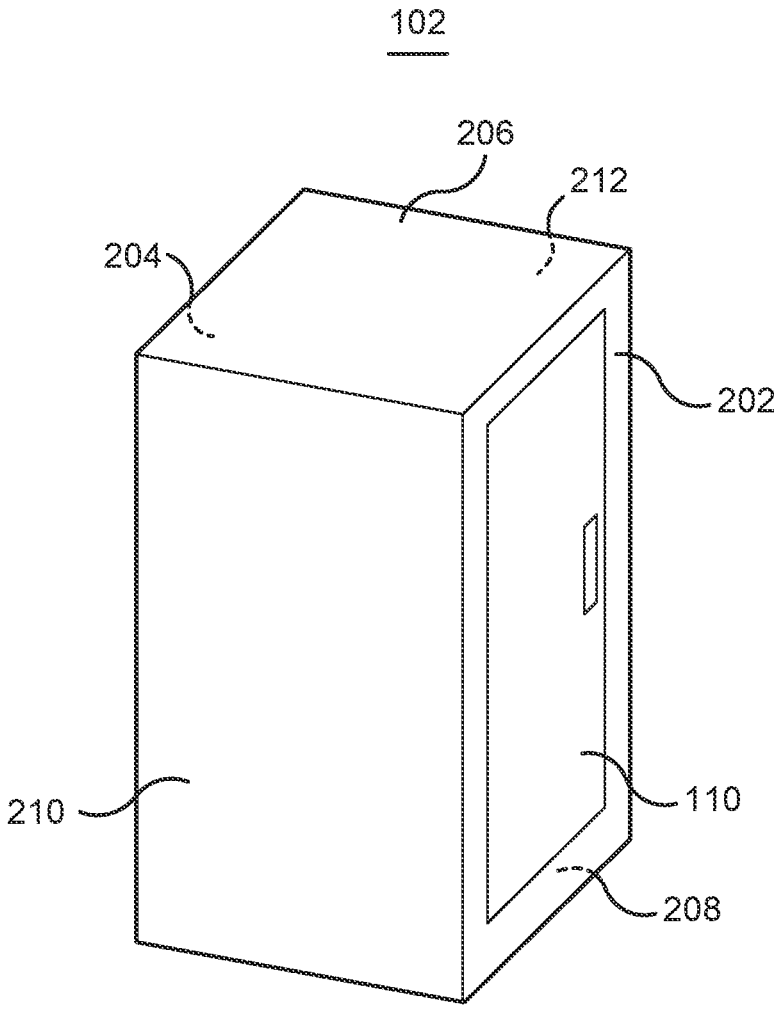
FIGS. 2A, 2B, and 2C illustrate an example cabinet in the system of FIGS. 1A and 1B.
Figure 2B:
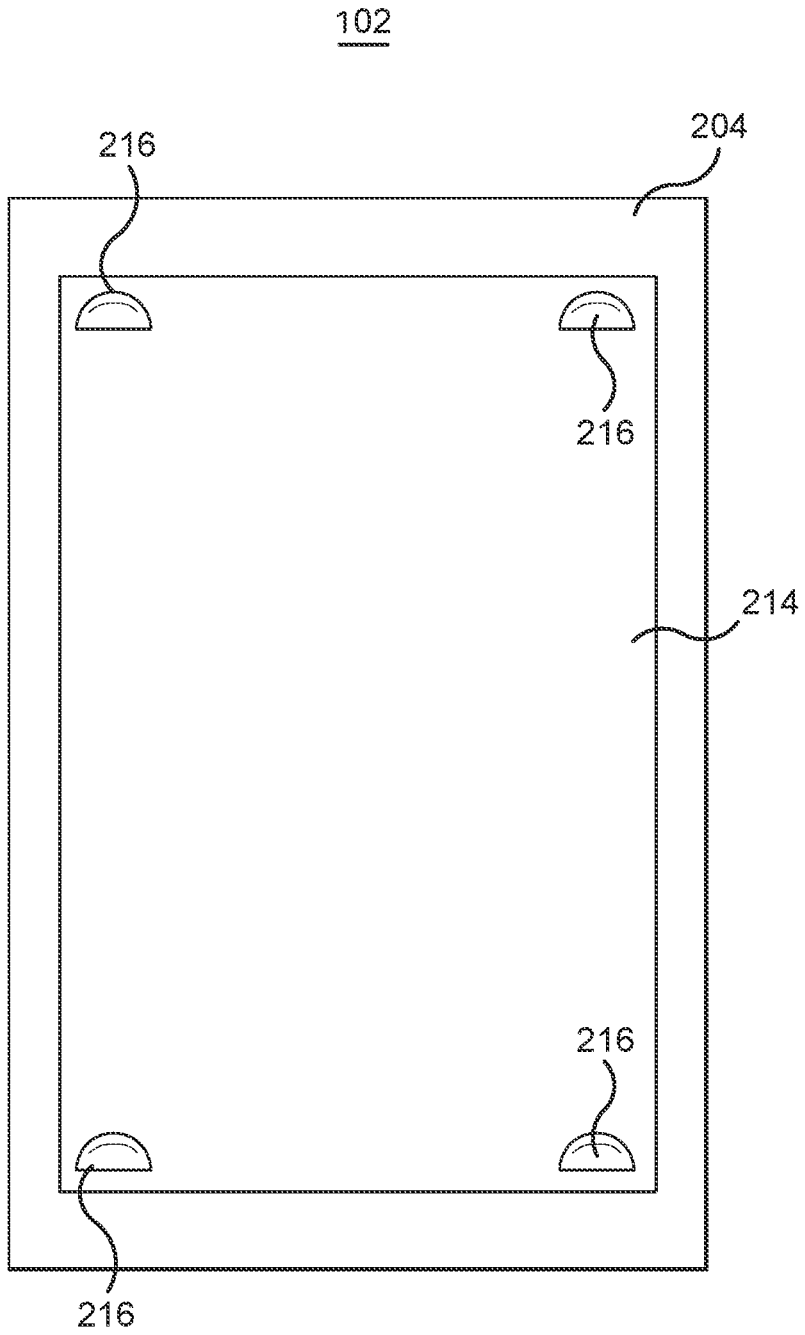
Figure 2C:
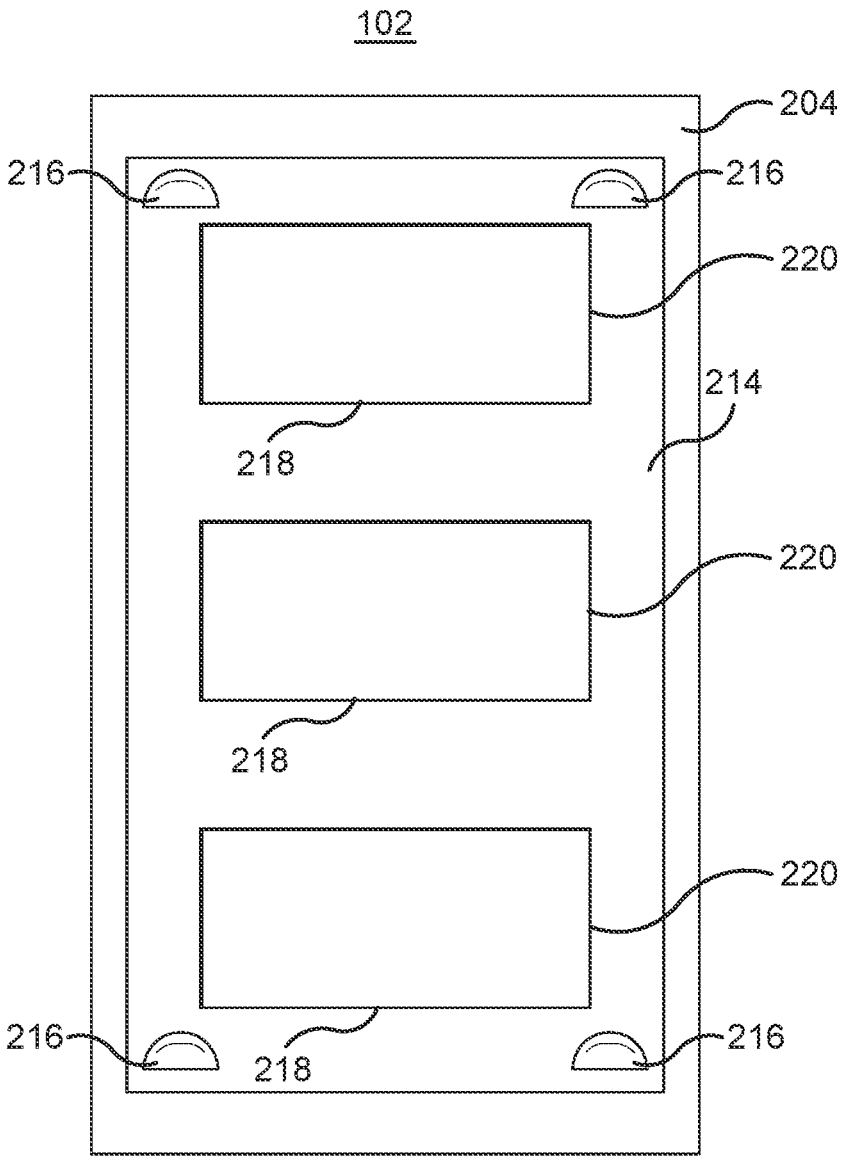

FIGS. 2A, 2B, and 2C illustrate an example cabinet 102 in the system 100 of FIGS. 1A and 1B. FIG. 2A illustrates an isometric view of the cabinet 102. As seen in FIG. 2A, the cabinet 102 includes a front side 202, a back side 204 opposite the front side 202, a top side 206, a bottom side 208 opposite the top side 206, a left side 210, and a right side 212 opposite the left side 210. Generally, the front side 202, back side 204, top side 206, bottom side 208, left side 210 and right side 212 are coupled to each other to form a box shape for the cabinet 102. The cabinet 102 may not be limited to a box shape. For example, the cabinet 102 may have slanted portions or sides, or curved portions or sides.

The door 110 may be positioned on the front side 202 of the cabinet 102. As discussed previously, the door 110 may be opened to provide access to the interior of the cabinet 102. The door 110 may be closed to limit or prevent access to the interior of the cabinet 102. In some embodiments, the door 110 may include a lock that may prevent the door 110 from opening. As a result, the lock may improve the security of the equipment 112 stored within the cabinet 102.

FIG. 2B illustrates the back side 204 of the cabinet 102. As see in FIG. 2B, the cabinet 102 includes a sleeve 214 positioned on the back side 204 of the cabinet 102. A portion of the sleeve 214 may extend into the interior of the cabinet 102. A back side of the sleeve 214 may be positioned substantially flush (e.g., within one centimeter) with the back side 204 of the cabinet 102. Additionally, one or more handles 216 may be positioned on the sleeve 214. The handles 216 may be gripped and pulled to pull the sleeve 214 out of the cabinet 102 from the back side 204, which expands the storage capacity of the cabinet 102. The sleeve 214 may include any suitable mechanisms that allow the sleeve 214 to be pulled out of the cabinet 102 and pushed back into the cabinet 102. For example, instead of the handles 216, the sleeve 214 may include slots or ridges that may allow the sleeve 214 to be pulled from the cabinet 102.

FIG. 2C illustrates an alternative example of the back side 204 of the cabinet 102. As seen in FIG. 2C, the back side 204 of the cabinet 102 includes the sleeve 214. A portion of the sleeve 214 may be positioned in the cabinet 102, and the back side of the sleeve 214 may be positioned substantially flush with the back side 204 of the cabinet 102. Additionally, the sleeve 214 includes one or more handles 216 that may be used to pull the sleeve 214 out from the cabinet 102 to expand the storage capacity of the cabinet 102.

The sleeve 214 also includes panels 218 that are attached to the sleeve 214. As seen in FIG. 2C, when the sleeve 214 is positioned flush with the back side 204 of the cabinet 102, the panels 218 may be folded up so that the panels 218 cover cavities 220 defined by the sleeve 214. When the sleeve 214 is pulled out from the back side 204 of the cabinet 102, the panels 218 may fold down towards the cabinet 102 to create shelves. When the panels 218 fold down, the cavities 220 may be exposed or uncovered. As a result, the cavities 220 may provide an opening through which equipment may be placed on the shelves created by the folded down panels 218.

Figure 3A:
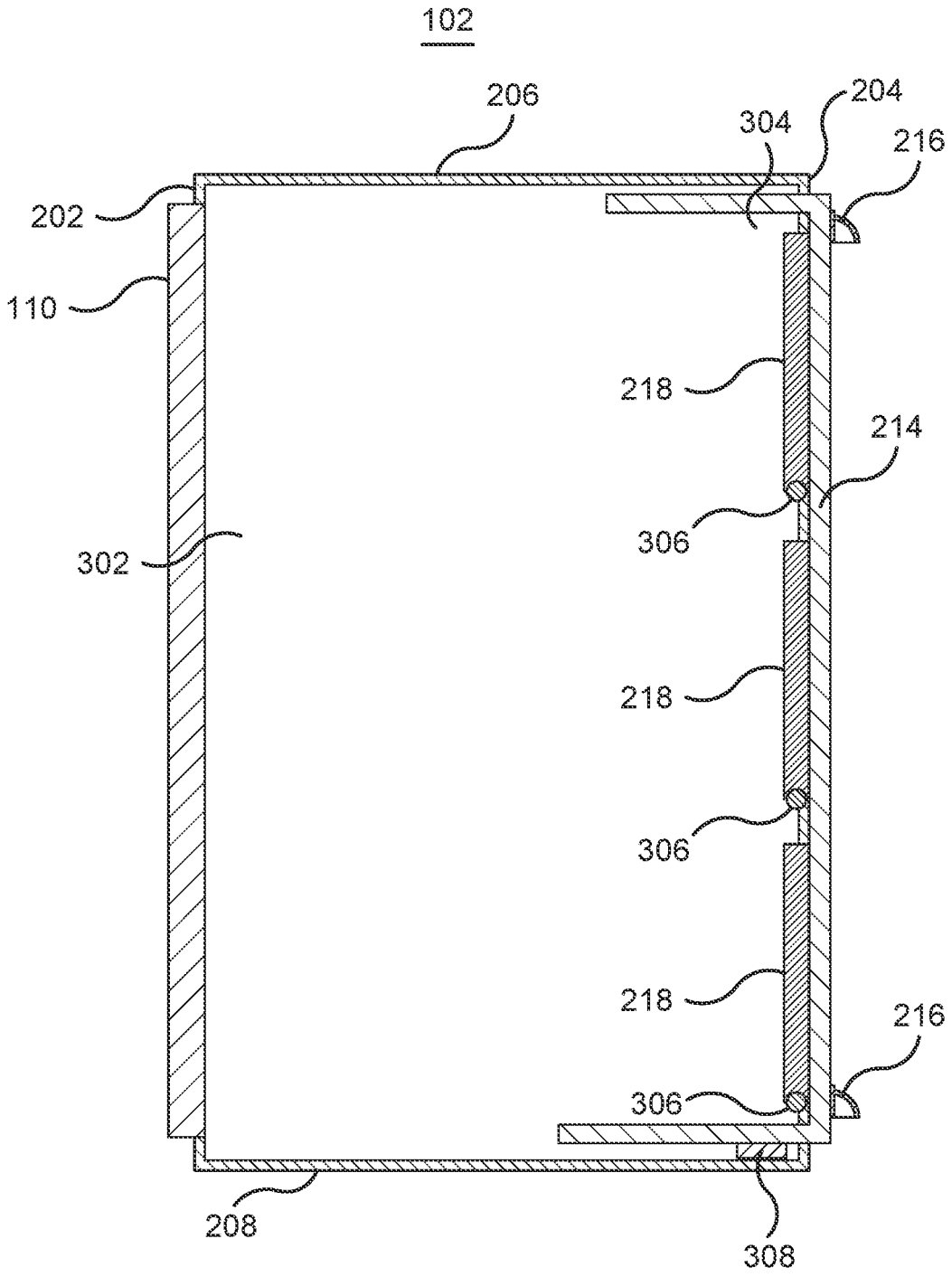
FIGS. 3A and 3B illustrate an example cabinet in the system of FIGS. 1A and 1B.
Figure 3B:
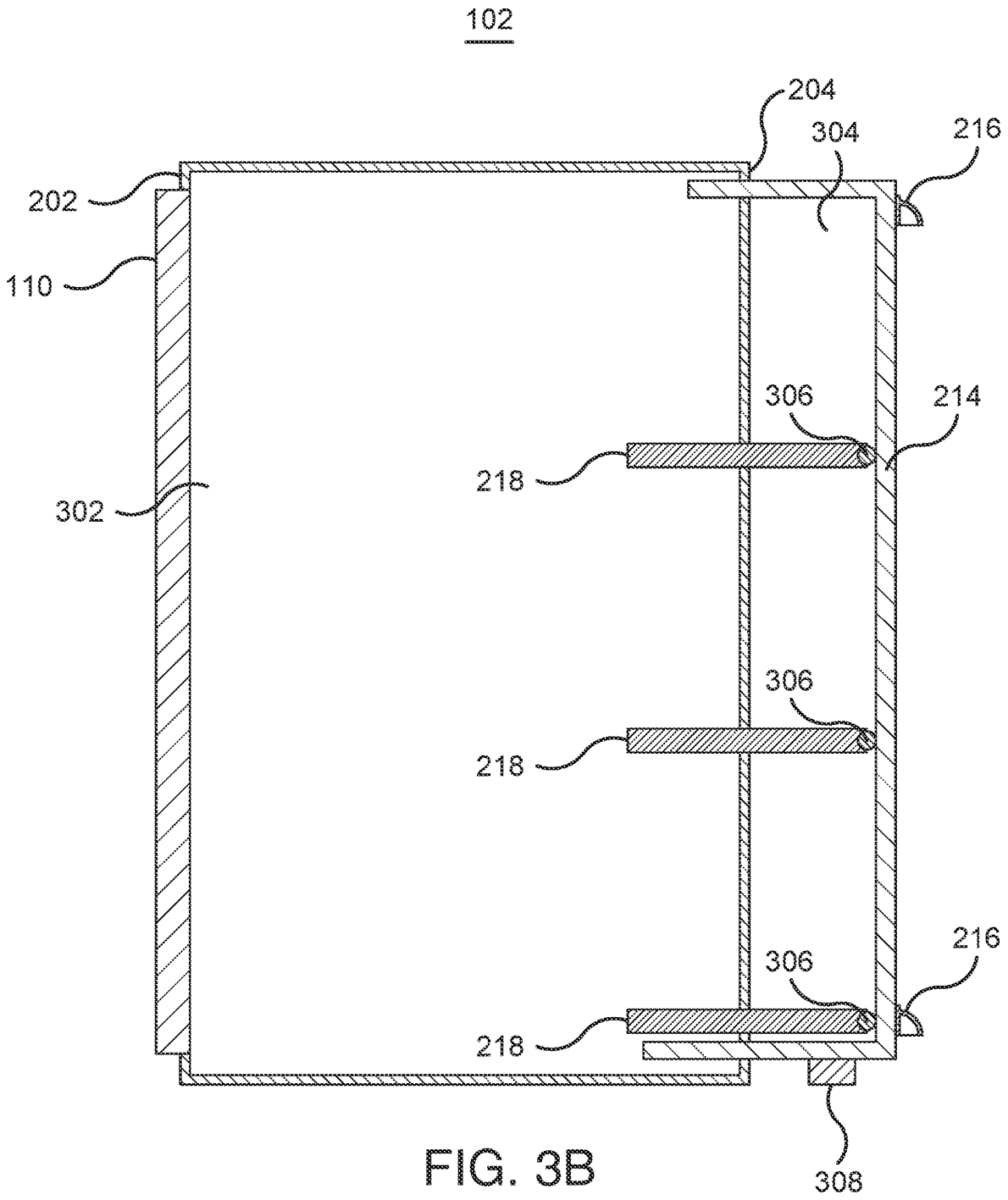

FIGS. 3A and 3B illustrate an example cabinet 102 in the system 100 of FIGS. 1A and 1B. Specifically, FIGS. 3A and 3B provide a cross-sectional view of the cabinet 102 from the side of the cabinet 102. As seen in FIG. 3A, the cabinet 102 includes the front side 202, the back side 204, the top side 206, and the bottom side 208. The door 110 is positioned on the front side 202 of the cabinet 102. The cabinet 102 defines an interior 302. The equipment 112 may be stored in the interior 302 of the cabinet 102.

In the example of FIG. 3A, the sleeve 214 is in a stored state. A portion of the sleeve 214 is stored within the interior 302 of the cabinet 102. A back side of the sleeve 214 is positioned substantially flush with the back side 204 of the cabinet 102. The sleeve 214 defines an interior chamber 304, which may occupy a portion of the interior 302 of the cabinet 102 when the sleeve 214 is in the stored state. The panels 218 of the sleeve 214 are folded up (e.g., against the sleeve 214) within the chamber 304. Additionally, the handles 216 are positioned on the sleeve 214. The handles 216 may be pulled to pull the sleeve 214 away from the front side 202 of the cabinet 102 and out from the back side 204 of the cabinet 102 to transition the sleeve 214 from the stored state to an extended state.

The panels 218 may be attached to the sleeve 214 by hinges 306. The hinges 306 may allow the panels 218 to rotate about the hinges 306. For example, when the sleeve 214 is pulled out from the back side 204 of the cabinet 102, the panels 218 may rotate downwards about the hinges 306 to produce shelves in the chamber 304. When the sleeve 214 is pushed back into the cabinet 102, the panels 218 may rotate upwards about the hinges 306 to fold up. In this manner, the panels 218 may rotate to produce additional storage when the sleeve 214 is pulled out from the back side 204 of the cabinet 102.

The sleeve 214 may include a support 308 positioned on a bottom of the sleeve 214. When the sleeve 214 is pulled out from the back side 204 of the cabinet 102, the support 308 may fold out to contact the ground and provide structural support for the sleeve 214. For example, the support 308 may support the weight of the sleeve 214 and any additional equipment that is added to the sleeve 214. The support 308 may compress or push into the sleeve 214 when the sleeve 214 is being pulled out from the back side 204 of the cabinet 102 so that the support 308 may clear the back side 204 of the cabinet 102.

FIG. 3B illustrates the cabinet 102 of FIG. 3A with the sleeve 214 pulled away from the front side 202 of the cabinet 102 and out from the back side of the cabinet 102 (e.g., in the extended state). As seen in FIG. 3B, when the sleeve 214 is pulled out from back side 204 of the cabinet 102, portions of the sleeve 214 may still be positioned within the interior 302 of the cabinet 102. As a result, the sleeve 214 may still form a closed space with the rest of the cabinet 102.

Additionally, when the sleeve 214 is pulled out from the back side 204 of the cabinet 102, the panels 218 rotate downwards about the hinges 306 to produce shelves in the chamber 304 defined by the sleeve 214. Additional equipment may be positioned on the shelves produced by the panels 218. For example, the equipment may include additional networking equipment (e.g., switches or routers), backup batteries, security tag deactivators, and power strips or boxes. In this manner, the sleeve 214 expands the storage capacity of the cabinet 102. In some embodiments, there may be mechanical connections that cause the panels 218 to automatically fold down when the sleeve 214 is pulled into the extended state and to automatically fold up when the sleeve 214 is pushed back into the cabinet 102 into the stored state. In certain embodiments, a user may manually rotate the panels 218 to create the shelves or to fold up the shelves.

In some embodiments, the back side of the sleeve 214 includes one or more doors that may be opened to access the chamber 304. For example, after the sleeve 214 is pulled out from the back side 204 of the cabinet 102 (e.g., the extended state) and the panels 218 are rotated down to create the shelves, the door may be opened to position equipment onto the shelves through the back side of the sleeve 214. These doors may then be closed (e.g., and locked) to secure the equipment. The doors may be opened to remove the equipment through the cavities.

The support 308 may fold out from the bottom of the sleeve 214. The support 308 may contact the ground and provide structural support for the sleeve 214. For example, the support 308 may support the weight of the sleeve 214 and the equipment positioned on the shelves produced by the panels 218. In some embodiments, a wheel is attached to the support 308. The wheel may assist the movement of the cabinet 102 when the sleeve 214 is in the extended state.

Figure 4A:
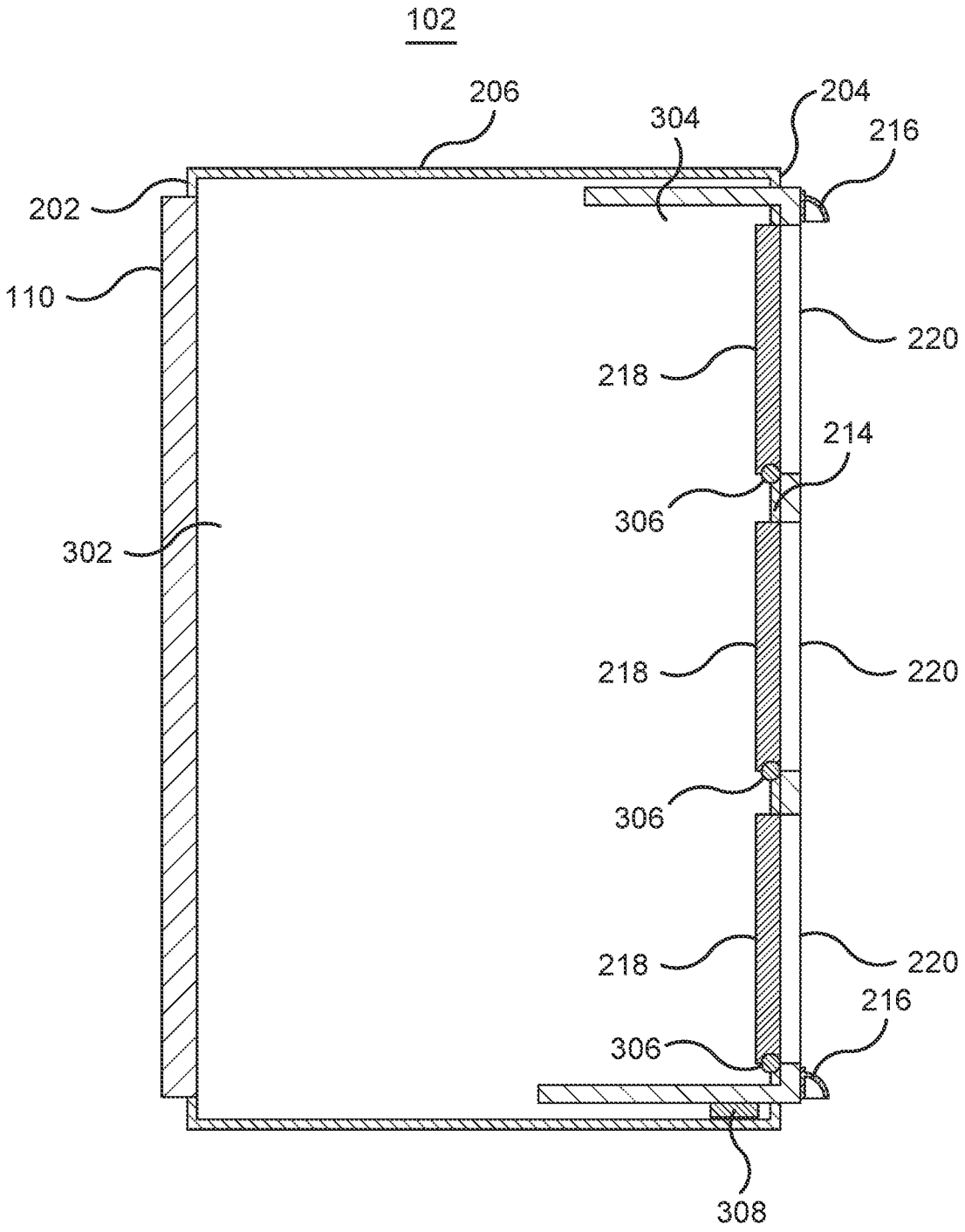
FIGS. 4A and 4B illustrate an example cabinet in the system of FIGS. 1A and 1B.
Figure 4B:
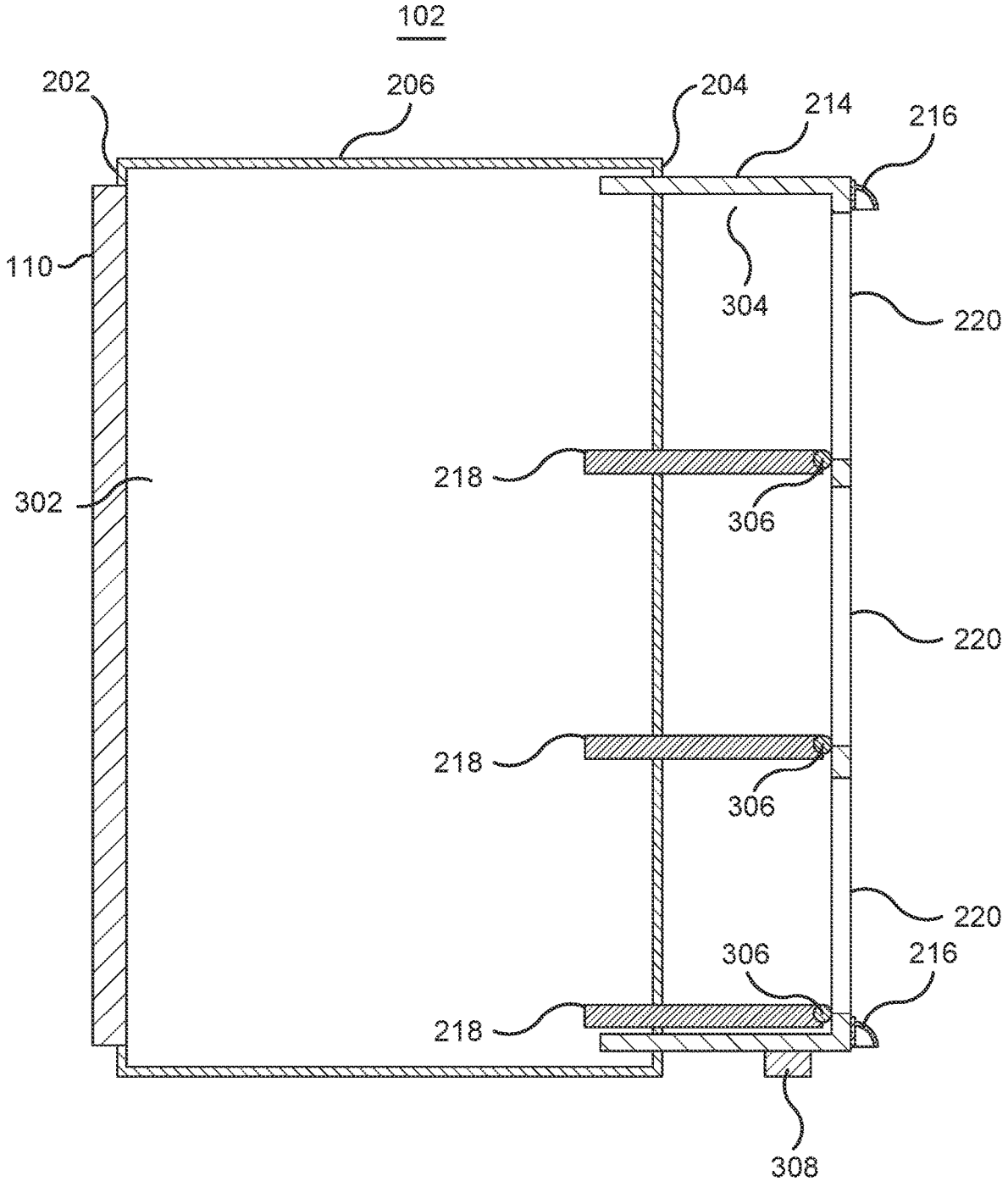

FIGS. 4A and 4B illustrate an example cabinet 102 in the system 100 of FIGS. 1A and 1B. Specifically, FIGS. 4A and 4B provide a cross-sectional view from the side of the cabinet 102. As seen in FIG. 4A, the sleeve 214 is in the stored state. The back side of the sleeve 214 is positioned substantially flush with the back side 204 of the cabinet 102. The panels 218 may be attached to the sleeve 214 by the hinges 306. Additionally, the panels 218 are folded up and cover the cavities 220 defined by the sleeve 214. As a result, the sleeve 214 and the panels 218 close off or seal the back side 204 of the cabinet 102.

FIG. 4B illustrates the sleeve 214 pulled away from the front side 202 of the cabinet 102 and out from the back side 204 of the cabinet 102 (e.g., the extended state). As seen in FIG. 4B, when the sleeve 214 is pulled out from the back side 204 of the cabinet 102, the panels 218 rotate down about the hinges 306 to produce shelves in the chamber 304 defined by the sleeve 214. For example, the panels 218 may automatically rotate down or a user may apply manual force to rotate the panels 218 down. Additional equipment may be positioned on the shelves produced by the panels 218. For example, the equipment may include additional networking equipment (e.g., switches or routers), backup batteries, security tag deactivators, and power strips or boxes. In this manner, the sleeve 214 expands the storage capacity of the cabinet 102 when the sleeve 214 is pulled out from the back side 204 of the cabinet 102.

Additionally, when the panels 218 rotate downwards, the cavities 220 defined by the sleeve 214 are exposed or uncovered. As a result the cavities 220 provide access to the shelves produced by the panels 218. Additional equipment may be positioned on the shelves through the cavities 220. Similar to previous examples, the sleeve 214 may be pushed back into the cabinet 102 to transition the sleeve 214 back to the stored state. The panels 218 may automatically fold up or the panels 218 may be manually folded up to cover the cavities 220.

In some embodiments, the back side of the sleeve 214 includes doors that cover the cavities 220. These doors may be opened or closed to uncover the cavities 220. For example, after the sleeve 214 is pulled out from the back side 204 of the cabinet 102 (e.g., the extended state) and the panels 218 are rotated down to create the shelves, these doors may be opened to position equipment through the cavities 220 and onto the shelves. These doors may then be closed (e.g., and locked) to secure the equipment. The doors may be opened to remove the equipment through the cavities.

Similar to previous examples, the support 308 may pop out or rotate out when the sleeve 214 is pulled out from the back side 204 of the cabinet 102. The support 308 may contact the ground to provide structural support for the sleeve 214. For example, the support 308 may support the weight of the sleeve 214 and the equipment positioned in the sleeve 214. The support 308 may compress or push into the sleeve 214 when the sleeve 214 is being pulled out from the back side 204 of the cabinet 102 so that the support 308 may clear the back side 204 of the cabinet 102.

Figure 5A:
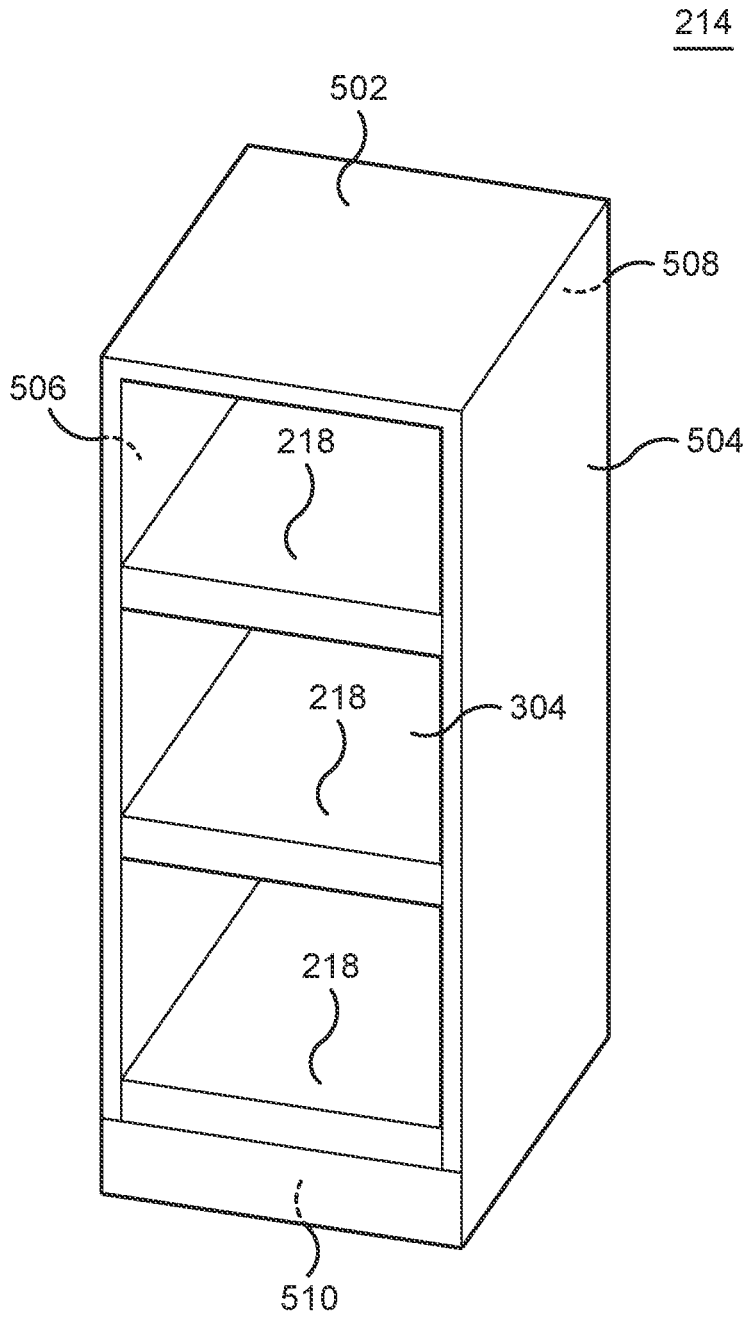
FIGS. 5A and 5B illustrate example sleeves.
Figure 5B:
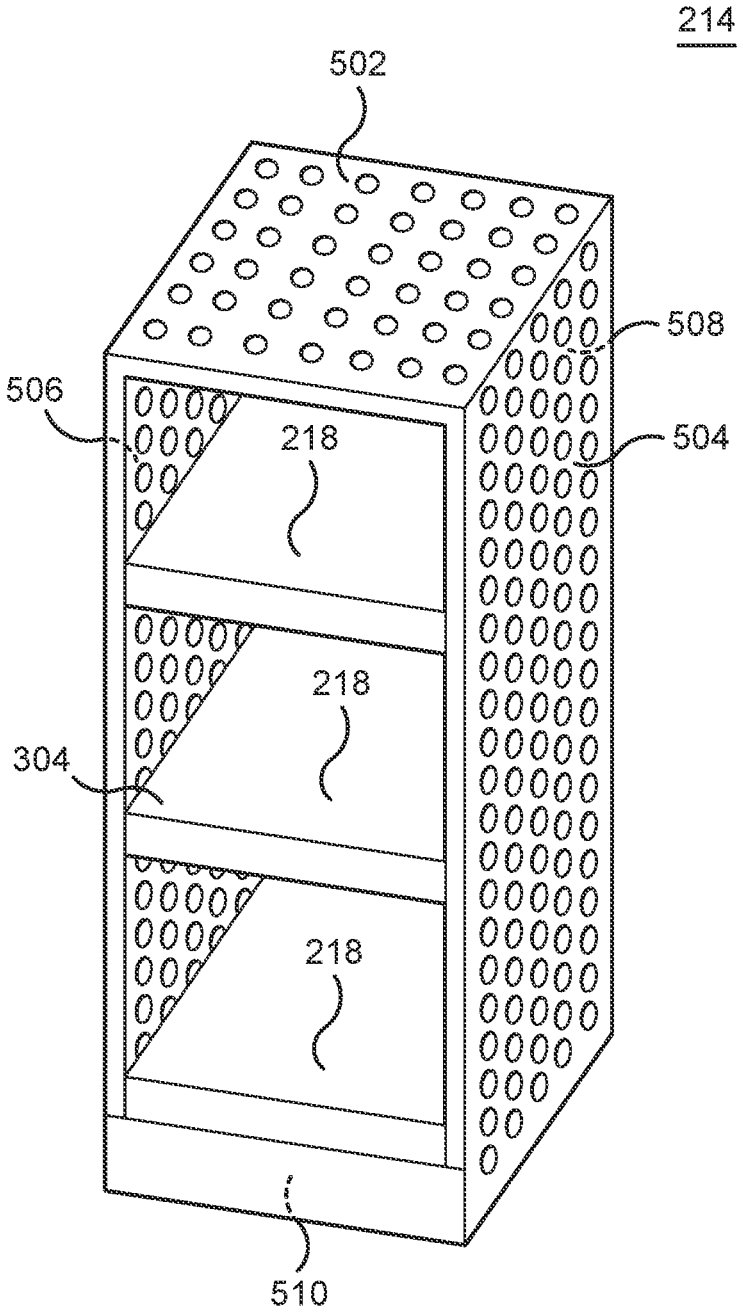

FIGS. 5A and 5B illustrate example sleeves 214. Specifically, FIGS. 5A and 5B illustrate isometric views of the sleeve 214. As seen in FIG. 5A, the sleeve 214 may include a top side 502, a right side 504, a left side 506, a back side 508, and a bottom side 510 that define the interior chamber 304 of the sleeve 214. Additionally, the panels 218 may be rotated downwards to create shelves in the interior chamber 304 of the cabinet 102. Additional equipment may be positioned on these shelves. In this manner, the sleeve 214 expands the storage capacity of the cabinet 102.

FIG. 5B illustrates another example of the sleeve 214. Similar to the example of FIG. 5A, the sleeve 214 includes the top side 502, the right side 504, the left side 506, the back side 508, and the bottom side 510. Additionally, the panels 218 have rotated downwards to produce the shelves in the interior chamber 304 of the sleeve 214. In the example of FIG. 5B, the top side 502, right side 504, left side 506, and back side 508 may be perforated. For example, the top side 502, right side 504, left side 506, and back side 508 may include holes formed through the top side 502, right side 504, left side 506, and back side 508. These holes may improve the airflow through the interior chamber 304 of the sleeve 214. As a result, the holes may improve the cooling for equipment positioned on the shelves produced by the panels 218.

Figure 6A:
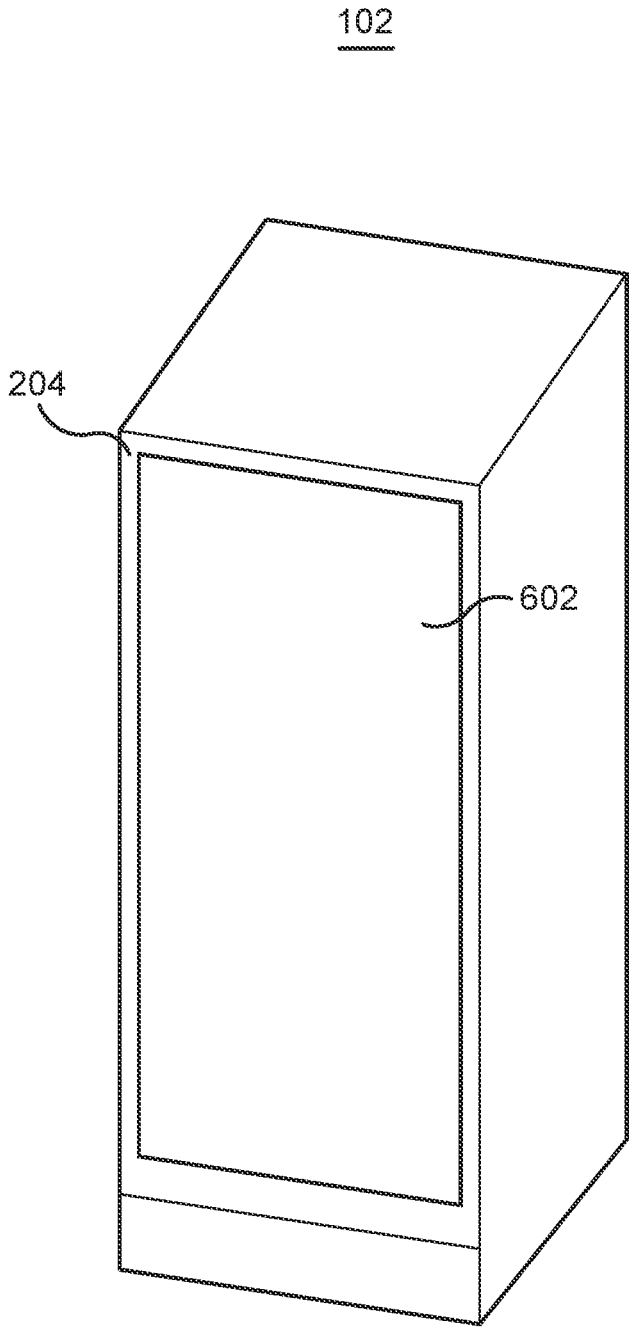
FIGS. 6A, 6B, and 6C illustrate an example cabinet in the system of FIGS. 1A and 1B.
Figure 6B:
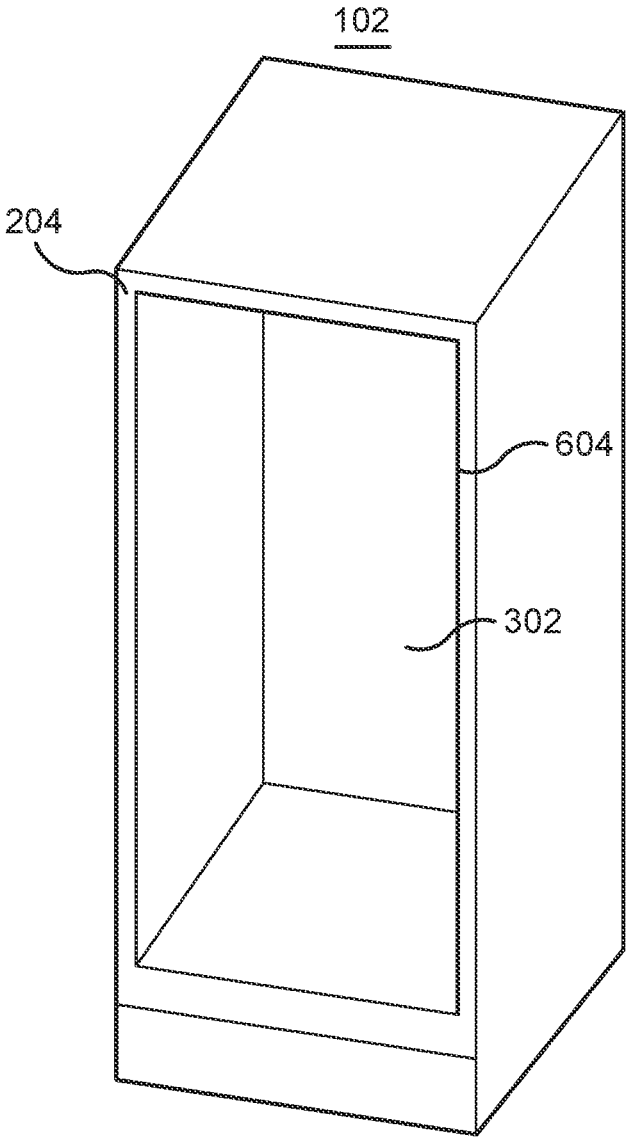
Figure 6C:
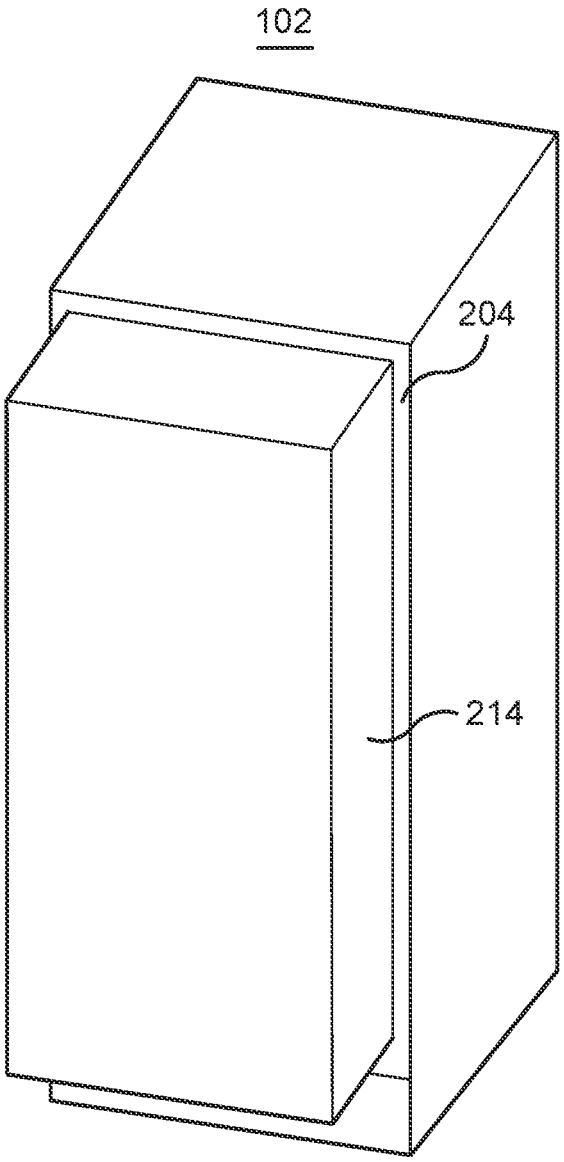

FIGS. 6A, 6B, and 6C illustrate an example cabinet 102 in the system 100 of FIGS. 1A and 1B. Generally, in the example of FIGS. 6A, 6B, and 6C, the storage capacity of the cabinet 102 is expanded by attaching the sleeve 214 to the back side 204 of the cabinet 102. When the additional storage capacity is not needed, the sleeve 214 may be detached from the cabinet 102, and the back side 204 of the cabinet 102 may be sealed off. As seen in FIG. 6A, the back side 204 of the cabinet 102 includes a cover 602. The cover 602 may seal off the back side 204 of the cabinet 102. The cover 602 may be removed to open the back side 204 of the cabinet 102.

FIG. 6B illustrates the back side 204 of the cabinet 102 with the cover 602 removed. As seen in FIG. 6B, the back side 204 of the cabinet 102 includes a cavity 604. When the cover 602 is removed, the cavity 604 is uncovered to expose the interior 302 of the cabinet 102.

FIG. 6C illustrates the back side 204 of the cabinet 102 after the sleeve 214 is attached to the back side 204 of the cabinet 102. The sleeve 214 may be attached to the back side 204 of the cabinet 102 after the cover 602 is removed. For example, the sleeve 214 may be bolted or screwed onto the back side 204 of the cabinet 102. Similar to previous embodiments, the sleeve 214 may provide shelves that increase the storage capacity of the cabinet 102. As a result, in the example of FIGS. 6A, 6B and 6C, the sleeve 214 may not be pushed into the interior 302 of the cabinet 102 when the sleeve 214 is not being used. Instead, the sleeve 214 may be uncoupled or detached from the back side 204 of the cabinet 102 when the sleeve 214 is not being used. After the sleeve 214 is removed, the cover 602 may be reattached to the back side 204 of the cabinet 102 to seal off the cabinet 102.

In summary, the system 100 (e.g., a self-checkout system) includes a modifiable cabinet 102. Generally, the cabinet 102 includes a sleeve 214 that can be used to expand the storage capacity of the cabinet 102. For example, the sleeve 214 may be pulled out from a back side 204 of the cabinet 102. Additional equipment may then be stored in the chamber 304 defined by the sleeve 214. Moreover, panels 218 in the sleeve 214 may fold down to create shelves when the sleeve 214 is pulled out from the back side 204 of the cabinet 102. The additional equipment may be positioned on the shelves for better organization.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s).

Aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system."

Embodiments of the present disclosure may include a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A self-checkout system comprising:

a cabinet comprising a front side and a back side opposite the front side;

a scanner positioned on the cabinet, wherein the scanner is arranged to scan an item during checkout;

a sleeve positioned within the cabinet, wherein the sleeve is arranged to move away from the front side of the cabinet and out the back side of the cabinet, wherein the sleeve defines a chamber; and a panel positioned within the chamber, wherein when the sleeve is moved away from the front side of the cabinet and out the back side of the cabinet, the panel folds down to create a shelf within the chamber.

2. The self-checkout system of claim 1, wherein the sleeve comprises a back side, and wherein the back side of the sleeve is substantially flush with the back side of the cabinet.

3. The self-checkout system of claim 1, wherein the panel is coupled to the sleeve by a hinge, and wherein the panel is arranged to rotate about the hinge to fold down to create the shelf.

4. The self-checkout system of claim 1, wherein the sleeve further comprises:

a first side; and a second side opposite the first side, wherein the first side and the second side are perforated.

5. The self-checkout system of claim 1, further comprising a second panel positioned within the chamber, wherein when the sleeve is moved away from the front side of the cabinet and out the back side of the cabinet, the second panel folds down to create a second shelf within the chamber.

6. The self-checkout system of claim 1, wherein the sleeve comprises:

a back side;

a first side coupled to the back side;

a second side opposite the first side and coupled to the back side; and a door positioned on the back side, the first side, or the second side, wherein the door provides access to the chamber.

7. The self-checkout system of claim 1, wherein when the panel folds down, the panel exposes a cavity in the sleeve, wherein the cavity provides access to the chamber.

8. The self-checkout system of claim 1, further comprising a support coupled to the sleeve, wherein the support is arranged to fold out to contact the ground when the sleeve is moved away from the front side of the cabinet and out the back side of the cabinet.

9. The self-checkout system of claim 1, further comprising equipment positioned within the cabinet, wherein the equipment comprises a memory and a processor communicatively coupled to the memory, and wherein the processor is configured to handle an output from the scanner.

* * * * *